US006375179B1

(12) United States Patent
Boss et al.

(10) Patent No.: US 6,375,179 B1
(45) Date of Patent: Apr. 23, 2002

(54) DEVICE FOR OPENING A FOLDED SIGNATURE AND DEPOSITING IT ONTO A RUNNING CONVEYOR

(75) Inventors: Heinz Boss, Strengelbach; Peter Merkli, Oftringen, both of (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/492,322

(22) Filed: Jan. 27, 2000

(30) Foreign Application Priority Data

Jan. 26, 1999 (EP) ..... 99810065

(51) Int. Cl.[7] ..... B65H 5/30

(52) U.S. Cl. ..... 270/52.27; 270/52.29; 270/52.26

(58) Field of Search ..... 270/52.23, 52.25, 270/52.26, 52.27, 52.29

(56) References Cited

U.S. PATENT DOCUMENTS 3,661,380 A * 5/1972 Muller ..... 270/52.25 X 4,775,137 A * 10/1988 Glanzmann ..... 270/52.29

FOREIGN PATENT DOCUMENTS

| | | |
|---|---|---|
| CH | 493 337 | 7/1970 |
| CH | 617 905 | 6/1980 |
| DE | 36 03 285 | 8/1986 |

* cited by examiner

*Primary Examiner*—Christopher P. Ellis
*Assistant Examiner*—Patrick Mackey

(57) ABSTRACT

A device for opening and depositing a folded signature onto a moving conveyor for conveying the folded signatures in a conveying direction includes two opening rollers each having a rotational axis that extends essentially parallel to the conveying direction of the conveyor. The opening rollers have a mechanism for opening the signatures and depositing the signatures with an open side first in a downward direction onto the conveyor. A pre-accelerating mechanism is operatively associated with the opening rollers for pre-accelerating the signatures in the conveying direction.

23 Claims, 11 Drawing Sheets

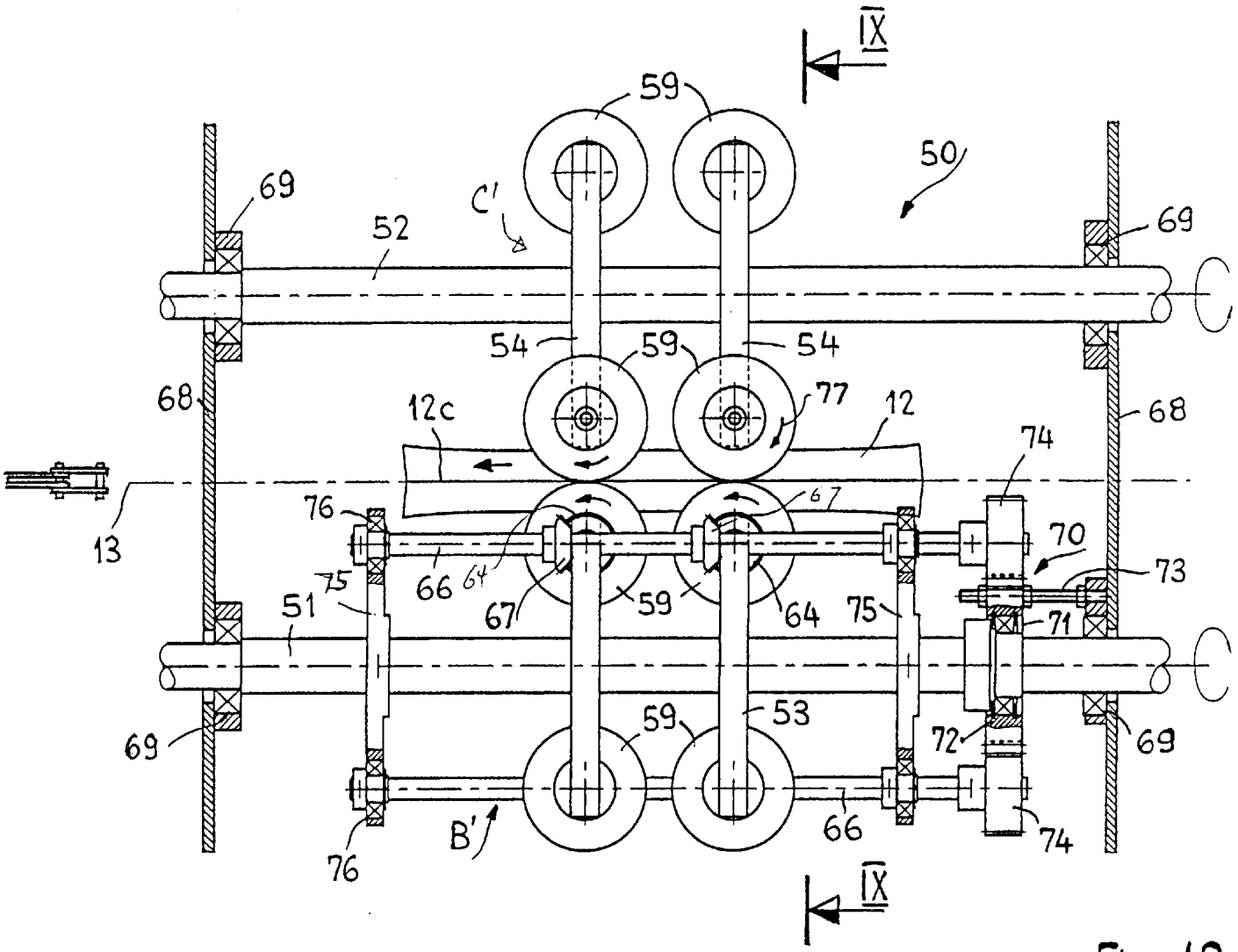
IX
IX
50
52
51
53
54
54
59
59
59

DEVICE FOR OPENING A FOLDED SIGNATURE AND DEPOSITING IT ONTO A RUNNING CONVEYOR

CROSS-REFERENCE TO RELATED APPLICATIONS

Priority is claimed with respect to European application No. 99810065.5-1256 filed Jan. 26, 1999, the disclosure of which is incorporated herein by reference.

BACKGROUND OF THE INVENTION

The invention relates to a device for opening and depositing a folded signature onto a moving conveyor, particularly a collecting chain, which device comprises two opening rollers with axes that extend essentially parallel to the conveying direction of the conveyor and respectively open one signature and deposit it with the opened side first in a downwardly direction onto the conveyor, wherein the signatures are pre-accelerated in the conveying direction of the conveyor.

Swiss Patent CH-A-617 905 discloses a device that allows paper signatures with off-center folds to be opened and deposited on a collecting chain. Such device comprises a continuously rotating take-up roller, as well as two opening rollers, arranged below it, which open the signatures and drop them onto the conveyor chain. In this case, the first opening roller seizes an overlay fold of the signature and the second opening roller subsequently seizes the other, shorter leg of the signature. Following the opening, the signatures are dropped directly downward, onto the moving conveyor chain. Carriers on the conveyor chain will move the signatures along. In the process, the signatures are pre-accelerated somewhat by the moving chain.

Past experience has shown that thin, four-page signatures can be dropped vertically and without pre-acceleration onto a collecting chain. However, at speeds higher than approximately 16,000 copies per hour, the signatures are compressed during the acceleration by the carriers to such a degree that they can no longer be accelerated reliably. Thus, it is the goal for high-production machines to have the smallest chain pitch, meaning the distance between two successive carriers and the back length of the format to be processed. Essentially, no time is available for accelerating the signatures with the aid of friction on the moving collecting chain. Thus, a further increase in output is not possible with this device, especially for thin signatures.

A similar device of the generic type is known from Swiss Patent CH-A-493 337. With this device, the opened signatures are deposited on a knife folder and are pre-accelerated through a movement of this knife folder. However, the acceleration with such a knife folder has not proven successful in practical operations. In addition, the vertically downward pointing speed component for statically charged signatures is missing here, which component is required for such signatures.

SUMMARY OF THE INVENTION

It is an object of the invention to create a device of the aforementioned type, which can still be produced cheaply and allows for a further increase in output.

The above and other objects are achieved in accordance with the invention by the provision of a device for opening and depositing folded signatures onto a moving conveyor for conveying the folded signatures in a conveying direction, comprising: two opening rollers each having a rotational axis that extends essentially parallel to the conveying direction of the conveyor and having means for opening the respective signatures and depositing the signatures with an opened side first in a downward direction onto the conveyor, wherein the opening rollers further include pre-accelerating means for pre-accelerating the respective signatures in the conveying direction.

With the device according to the invention, the signatures are respectively pre-accelerated in the horizontal direction by the opening rollers and prior to being dropped. Thus, the signatures are not dropped first and then accelerated, as is the case in the prior art, but are accelerated horizontally on the opening rollers before being dropped. Thus, they are provided with a horizontal as well as a vertical speed component. The acceleration operation follows immediately after the opening operation and on the opening rollers. The essential feature is that the signatures can be carried along without interruption until they leave the opening rollers. The acceleration operation consequently occurs downstream, immediately after the opening operation.

The opening rollers preferably accelerate the signatures in the horizontal direction when the lower, opened side of the signatures already overlaps the conveyor chain. After the signatures are dropped, they are immediately taken over by the conveyor chain and are transported along by this chain. Experiments have shown that even very thin signatures can be safely processed with a higher output than has been possible so far.

The fact that the vertical drop component is retained is seen as another essential advantage of the device according to the invention. As a result, it is also possible to process signatures with electrostatic charge, which must be dropped with a predetermined minimum vertical speed onto the conveyor chain or the collecting chain. This is hardly possible with a pre-acceleration by means of the so-called knife folder.

According to one embodiment of the invention, a particularly cost-effective and operationally secure implementation of the invention is ensured if accelerating rollers are provided which are respectively arranged at an angle on the shafts for the two opening rollers. With the aid of these accelerating rollers, the signatures are seized on the outside immediately following the opening by the opening disks and are accelerated in the conveying direction of the conveyor. It is preferable if these accelerating rollers are designed as profile rollers. In that case, signatures having a varied thickness can be processed without requiring a device change-over, provided at least one of the angled accelerating rollers has an elastic support, as detailed for one modification of the invention.

According to another embodiment of the invention, at least two driven cylinders are provided, which are respectively arranged on the opening disks of one opening roller and which operate jointly to seize and accelerate respectively one signature. With this modification, the means for accelerating the signatures are thus arranged directly on the opening disks. One essential advantage of this modification is that even very small formats can be processed. If these rollers have a design similar to that of a beehive, then the signatures are accelerated with a continuous increase when seized with these rollers. Thus, the horizontal speed is low at the start and at a maximum at the end.

Additional advantageous features follow from, the following detailed description, considered in conjunction with the accompanying drawings.

BRIEF DESCRIPTION OF THE DRAWINGS

In the following, two exemplary embodiments according to the invention are explained in further detail with the aid of the drawing.

FIG. 10 is a schematic of another embodiment of a device according to the invention.

DETAILED DESCRIPTION OF THE INVENTION

Figure 1:
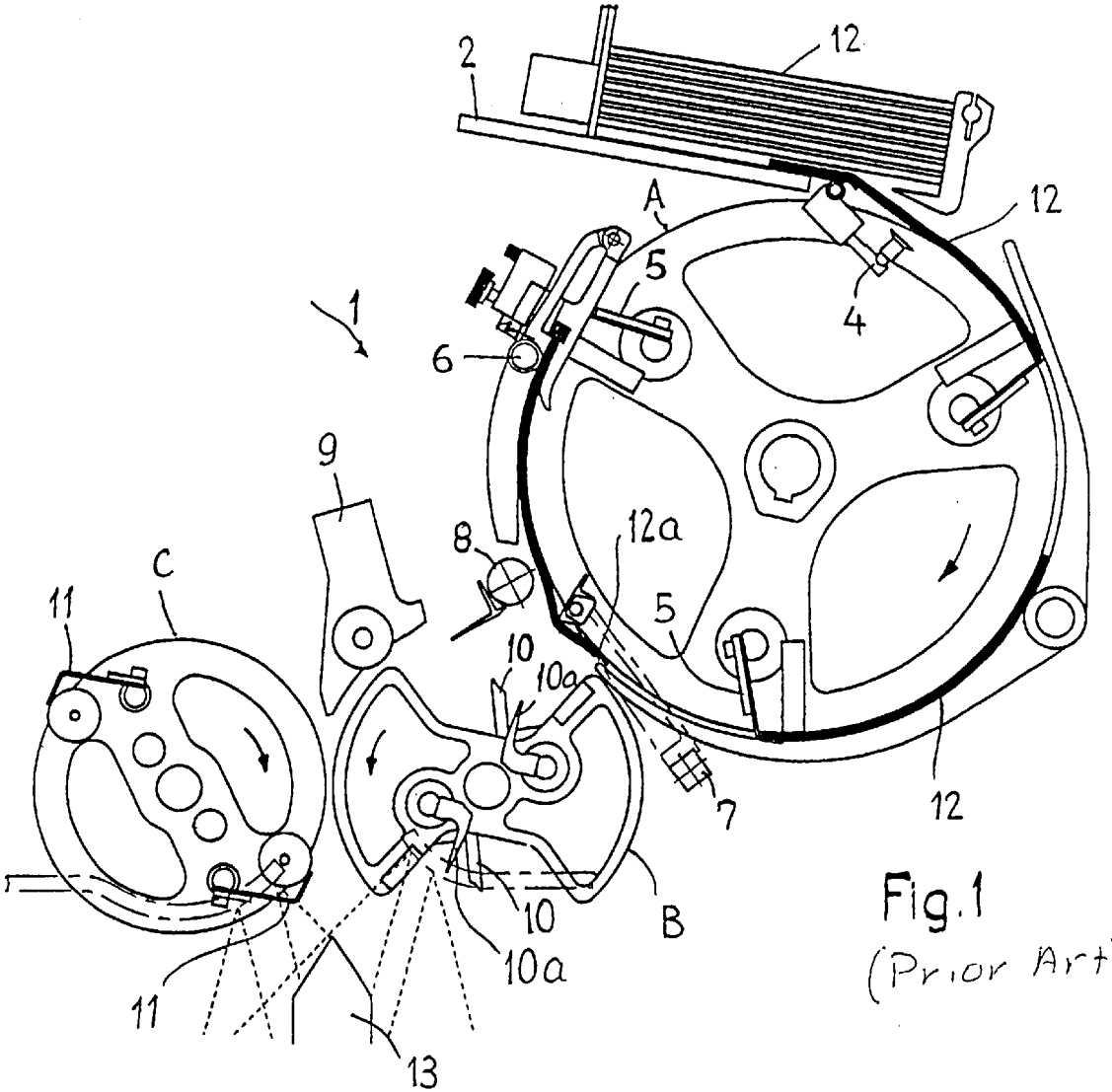
Fig. 1 (Prior Art)
FIG. 1 is a schematic showing components of a feeder based on the prior art.

FIG. 1 shows a feeder 1 based on prior art. With this feeder, printed products 12 with an off-center fold, arranged in a stack on a support 2, are deposited on a moving collecting chain 13. Collecting chain 13 conveys the signatures 12 perpendicular to the drawing plane in FIG. 1. Signatures 12 that have been collected on collection chain 13 are subsequently processed further, e.g. by means of a stapling device not shown here. However, this is not necessary.

Feeder 1 is provided with a take-up roller A which separate signatures 12 with the aid of a suction apparatus 4 and grippers 5 in a known manner. Take-up roller A can include one or several grippers 5. Grippers 5 respectively pull the signatures 12 against buffers 6, which can be adjusted to the format. A cam-controlled deflecting bar 7 transfers each signature 12 individually to the opening rollers B and C, wherein guide means 8 and 9 support this transfer. Opening roller B seizes signature 12 in a region of an overlay fold 12*a* with grippers 10 and pulls signature 12 away from buffers 6. The signature is subsequently placed between opening rollers B and C. In the process, gripper 10*a* seizes the overlay fold. Gripper 10 then releases signature 12 so that the latter opens up and gripper 11 of opening roller C can seize the shorter leg of signature 12. Signature 12 is then transported with the open side facing downward between opening rollers B and C and is dropped onto conveyor chain 13.

In the following explanation for the embodiments according to the invention, the take-up roller A is omitted, because it is known per se and can also be replaced with another device, which transfers the signatures 12 in a suitable manner to the opening rollers B and C.

Referring to FIGS. 2 to 8 there is shown one embodiment of a device 14 according to the invention. Device 14 includes opening rollers B and C, which are respectively provided with two opening disks 25, 26 and 23, 24 for transporting the signatures 12 individually in a manner known per se.

For illustrative reasons, the machine frame is left out here and only the bearing parts 17, 18 and 19, 20 are shown, which are rigidly secured to the frame.

Figure 2:
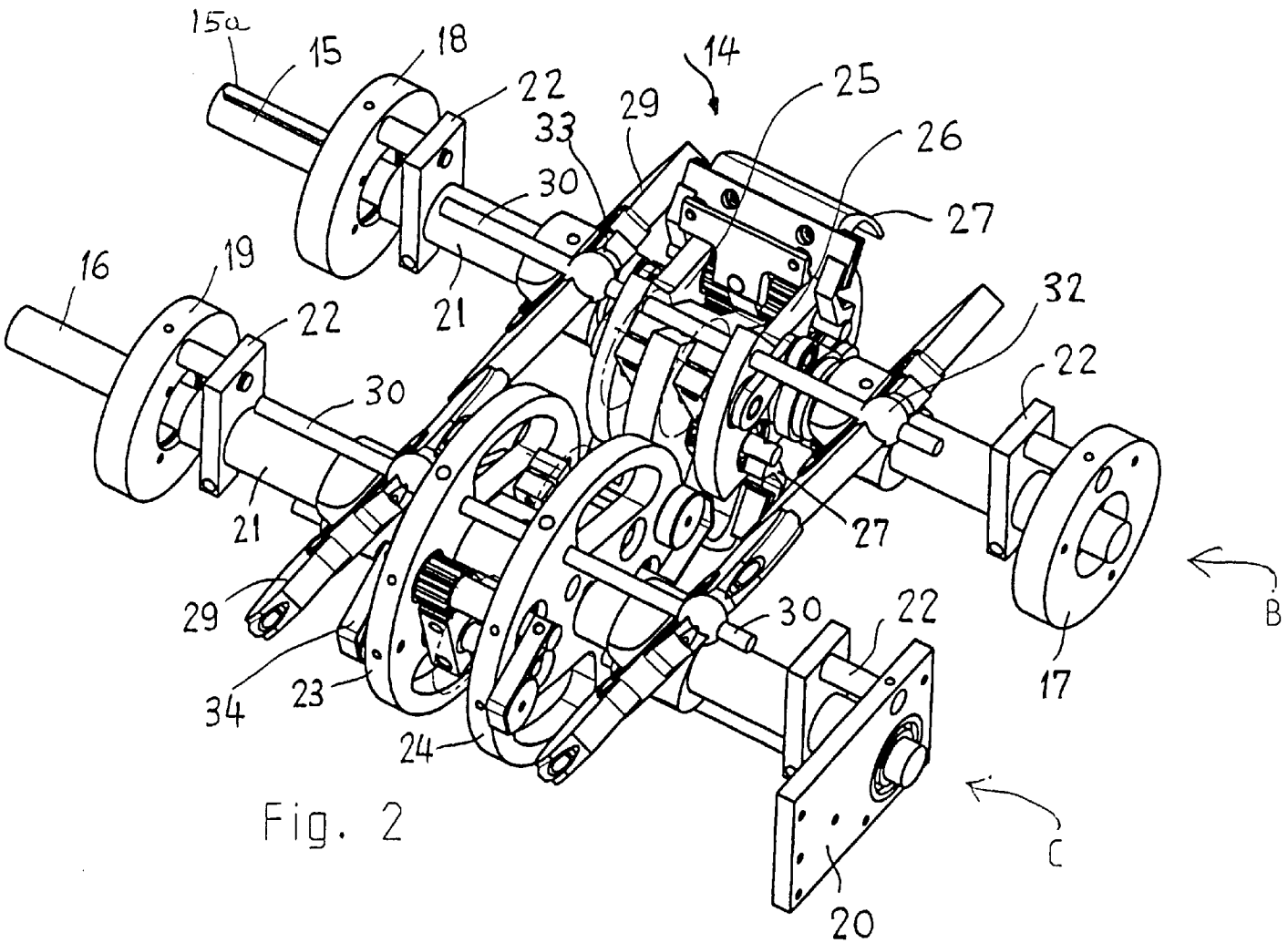
FIG. 2 is a schematic perspective view of one embodiment of a device according to the invention.
Figure 3:
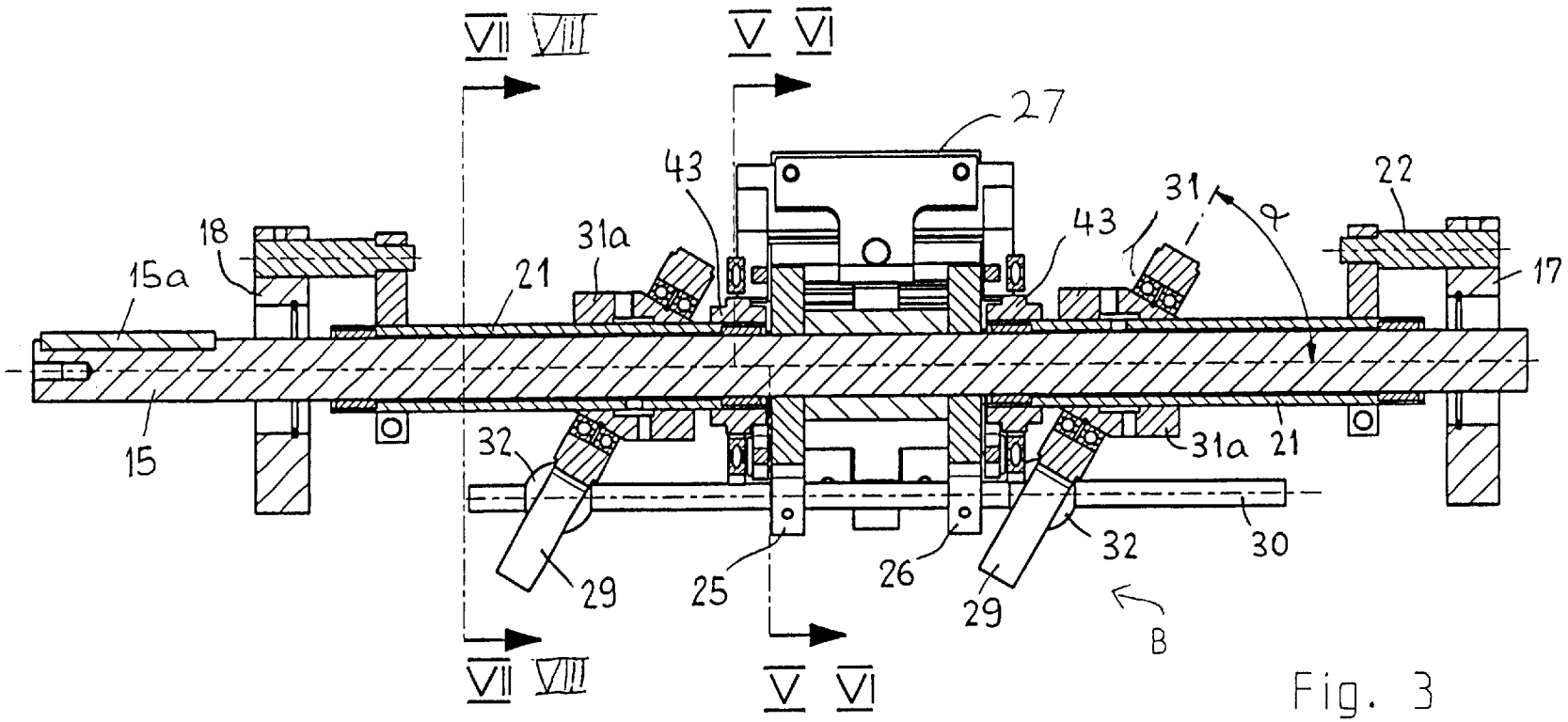
FIG. 3 is a section along the line III—III in FIG. 5.
Figure 4:
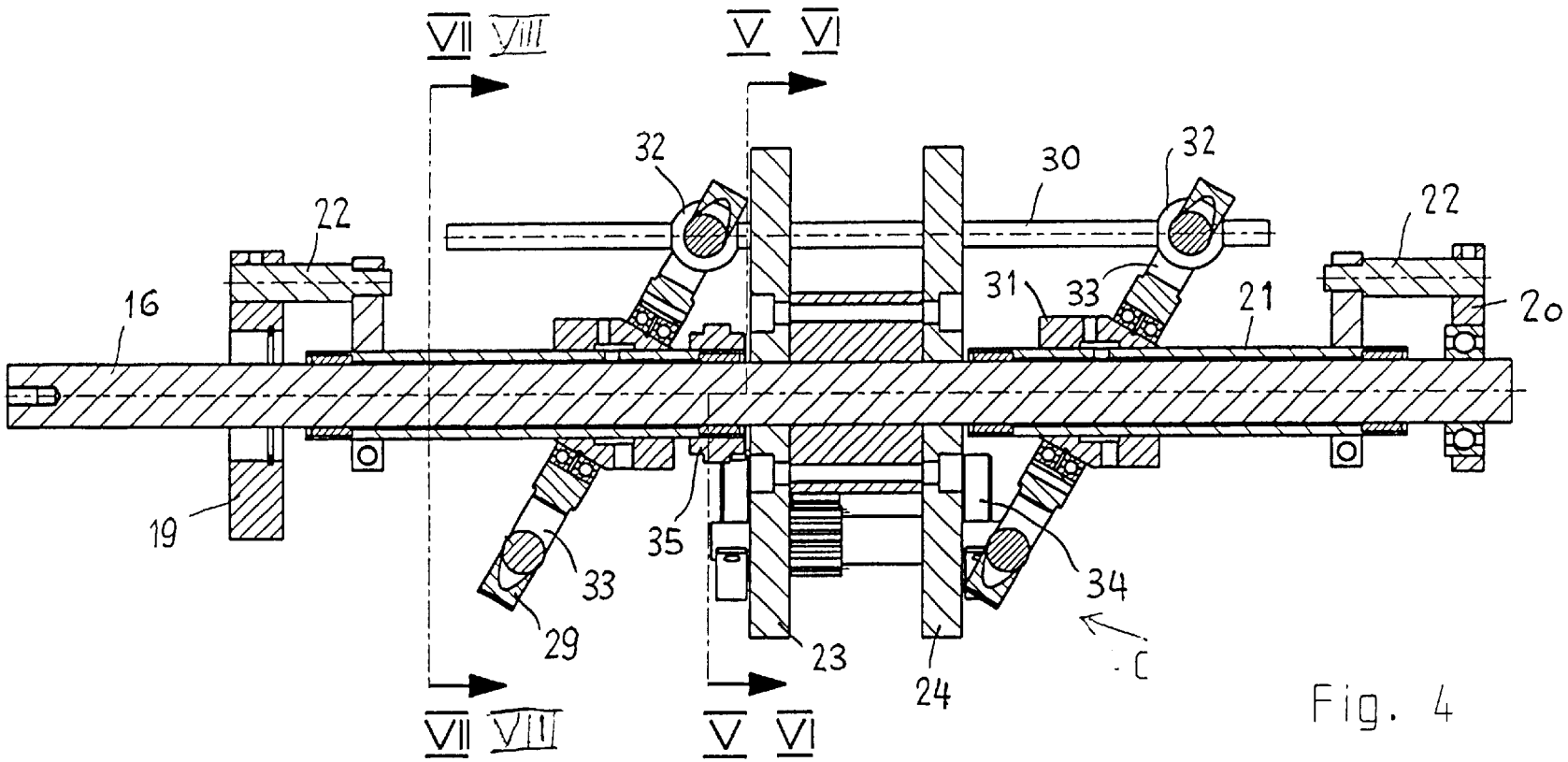
FIG. 4 is a section along the line IV—IV in FIG. 5.

According to FIGS. 2 and 3, opening roller B has a shaft 15, on which the two opening disks 25 and 26 are mounted parallel to each other. As shown in FIG. 3, grippers 27 are controlled in a manner known per se by cam disks 43, which are respectively supported on a two-part pipe 21 that is secured immovably to the frame. The two-part pipe 21 is secured with fastening means 22 on the machine frame, such that it cannot rotate, and is positioned on shaft 15. The two plate-shaped opening disks 25 and 26, which are arranged at a distance to each other, are positioned between the two parts of pipe 21 and are connected to shaft 15 so as to rotate along. Shaft 15 is provided with a driving wedge 15*a*, which is fixedly connected to a drive element that is not shown here. As can be seen, pipe 21 is arranged coaxial to shaft 15.

Two identical accelerating rollers 29 are arranged on the pipe 21, at a distance to each other and outside of the two opening disks 25 and 26, which rollers are inclined at an angle $\alpha$ to the axis for shaft 15 (see FIG. 3). This angle $\alpha$ is preferably an acute angle of, for example, approximately 30°. The two accelerating rollers 29 are respectively supported on pipe 21 with a suitable support 31*a*, such that they can turn. Roller bearings 31 are located on the support 31*a*. The support 31*a* determines the angled position of accelerating rollers 29.

The two accelerating rollers 29 are connected to the two opening disks 25 and 26 by means of two opposite-arranged guide rods 30. The accelerating rollers 29 thus turn along with the rotating opening disks 25 and 26. In order to make this rotation possible, the two guide rods 30 have respectively two balls 32, which are each positioned radially displaceable inside a separate slot 33. In addition, the balls 32 are guided in a longitudinal direction along guide rod 30. The two accelerating rollers 29 thus rotate along in the same direction and at the same speed as the shaft 15 and at the same time as the opening disks 25 and 26. The accelerating rollers 29 are not wobble plates and always maintain the angle of inclination shown in FIG. 2.

Opening roller C differs from opening roller B essentially in the design of the two opening disks 23 and 24 as well as the grippers 34. Since the person skilled in the art is familiar with the configuration and operation of grippers 34, these do not need to be explained in further detail here. Grippers 34 are also controlled via a control cam 35. According to FIG. 4, opening roller C also contains a shaft 16, located parallel to shaft 15 on bearing parts 19 and 20, which further supports a coaxial pipe 21 that is secured rigidly to the frame. In the same way as for the opening roller B, two accelerating rollers 29 are arranged on pipe 21 at a distance to each other and outside of opening disks 23 and 24. The angle of inclination for these accelerating rollers 29 is the same as for the opening roller B and they are also driven via two opposite-arranged guide rods 30.

Opening disks 23 and 24 operate jointly with opening disks 25 and 26, in the manner known per se, in order to open up signatures 12 individually and drop them downward onto conveyor chain 13. Accelerating rollers 29 also operate jointly in pairs and function to accelerate signatures 12 in the conveying direction of conveyor chain 13. Without these accelerating rollers 29, the opened signatures 12 would be tossed vertically downward and without horizontal speed components onto conveyor chain 13 and would thus be accelerated in the horizontal direction only by conveyor chain 13.

The process of opening and accelerating signatures 12 is explained in further detail in the following with the aid of FIGS. 5 to 8.

Figure 5:
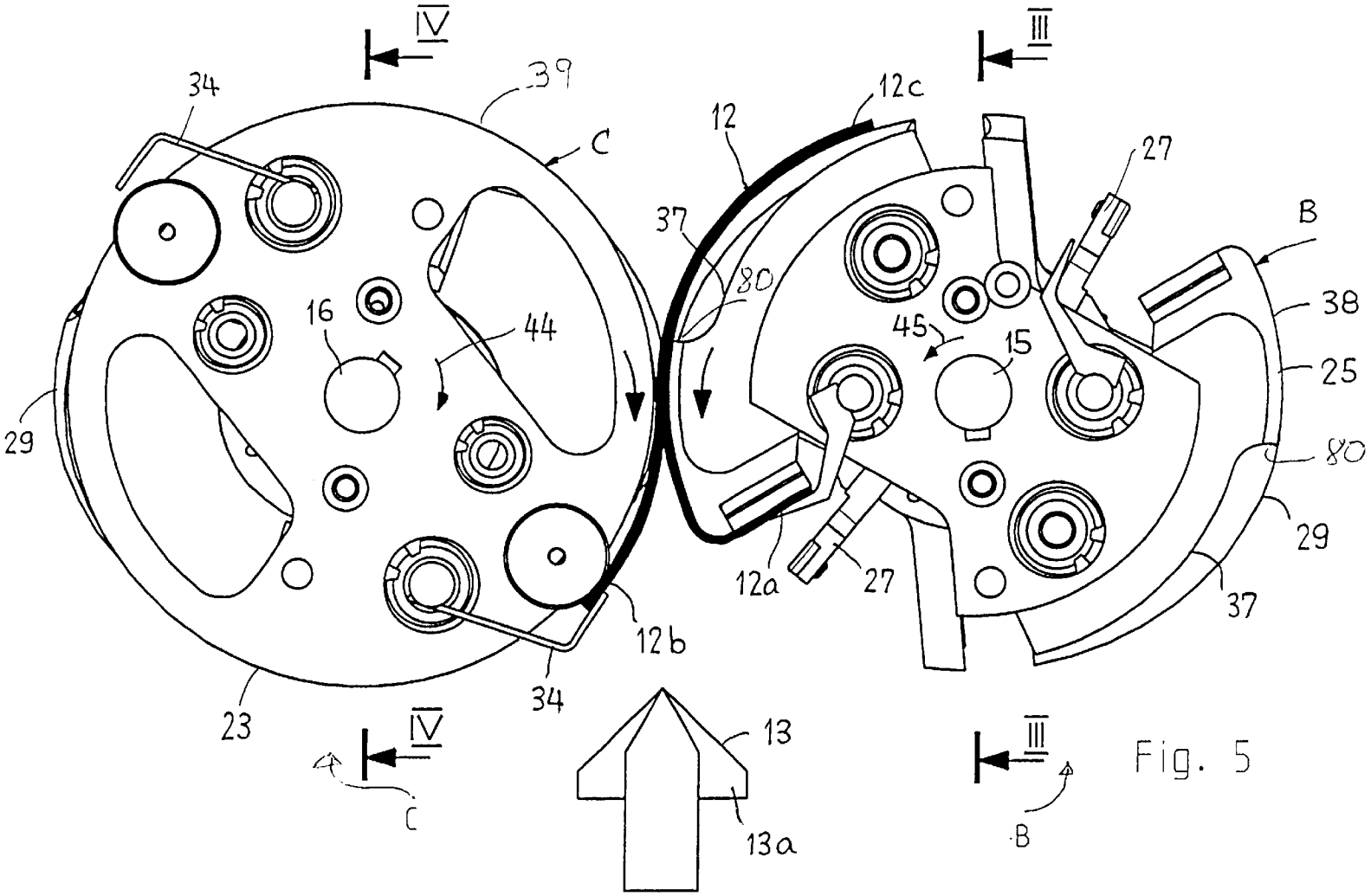
FIG. 5 is a section along the line V—V in FIGS. 3 and 4.

In the position of opening rollers B and C shown in FIG. 5, a signature 12 is seized along overlay fold 12*a* by grippers 27 of opening roller B and at end 12*b* of the shorter signature part by grippers 34 of opening roller C and is then partially opened. The two opening rollers B and C rotate around shafts 15 and 16, respectively, in the direction of arrows 44 and 45, in opposite directions, and transport signatures 12 with the opened side facing downward toward conveyor chain 13. The signature 12 in this case is clamped on its outside surfaces by surfaces 38 and 39 along the circumference of opening disks 23 to 26.

Figure 6:
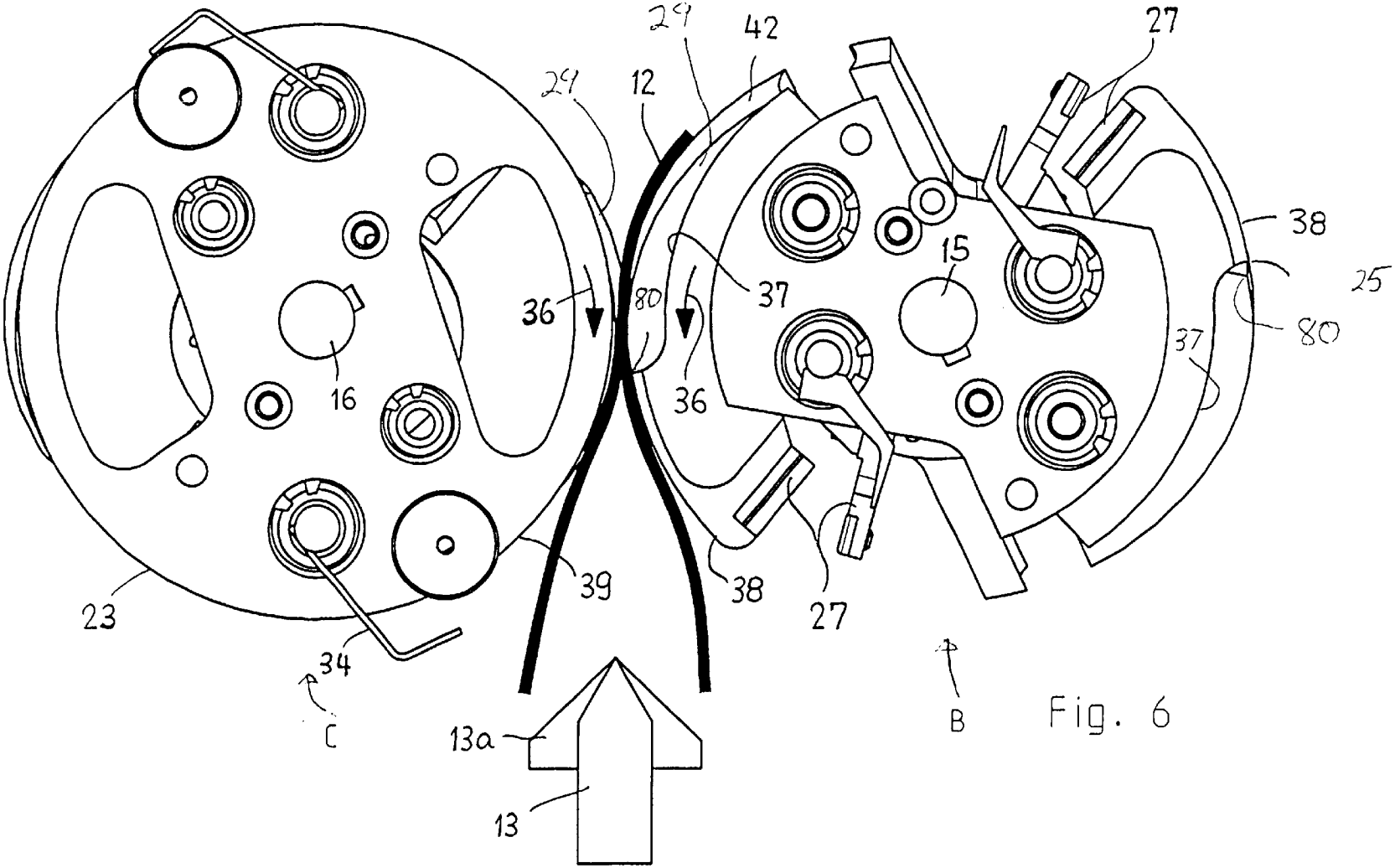
FIG. 6 is a section through the device according to the invention, along the line VI—VI in FIGS. 3 and 4, showing a different rotational position of shafts B and C.

In the position shown in FIG. 6, the lower, open end of signature 12 has reached conveyor chain 13, but is not yet acted upon by the carriers 13*a*. In that position, signature 12 is held by the accelerating rollers 29 and no longer by opening disks 23 to 26. The transition from the clamping by opening disks 23 to 26 to clamping by the accelerating rollers 29 occurs at the location 80, at which the clamping surfaces 38 for the opening disks 25 and 26 end and are replaced, essentially without interruption, by the clamping surfaces 42 of the accelerating rollers 29. At location 80, the clamping surface 38 is canceled out by a recess 37. The locations 80 are arranged diametrically opposite each other and thus in pairs. However, an embodiment with only one or more than two locations 80 and the corresponding number of grippers 27 is also conceivable. The clamping transition occurs in a position where signature 12 according to FIG. 6 is opened approximately halfway. A portion of signature 12 is therefore arranged below location 80 and another portion above location 80.

Thus, the effect of opening disks 23 to 26 on signature 12 is canceled and the signature 12 is then guided through the accelerating rollers 29. The transition occurs directly, so that signature 12 is always guided, even at the transition point.

Figure 7:
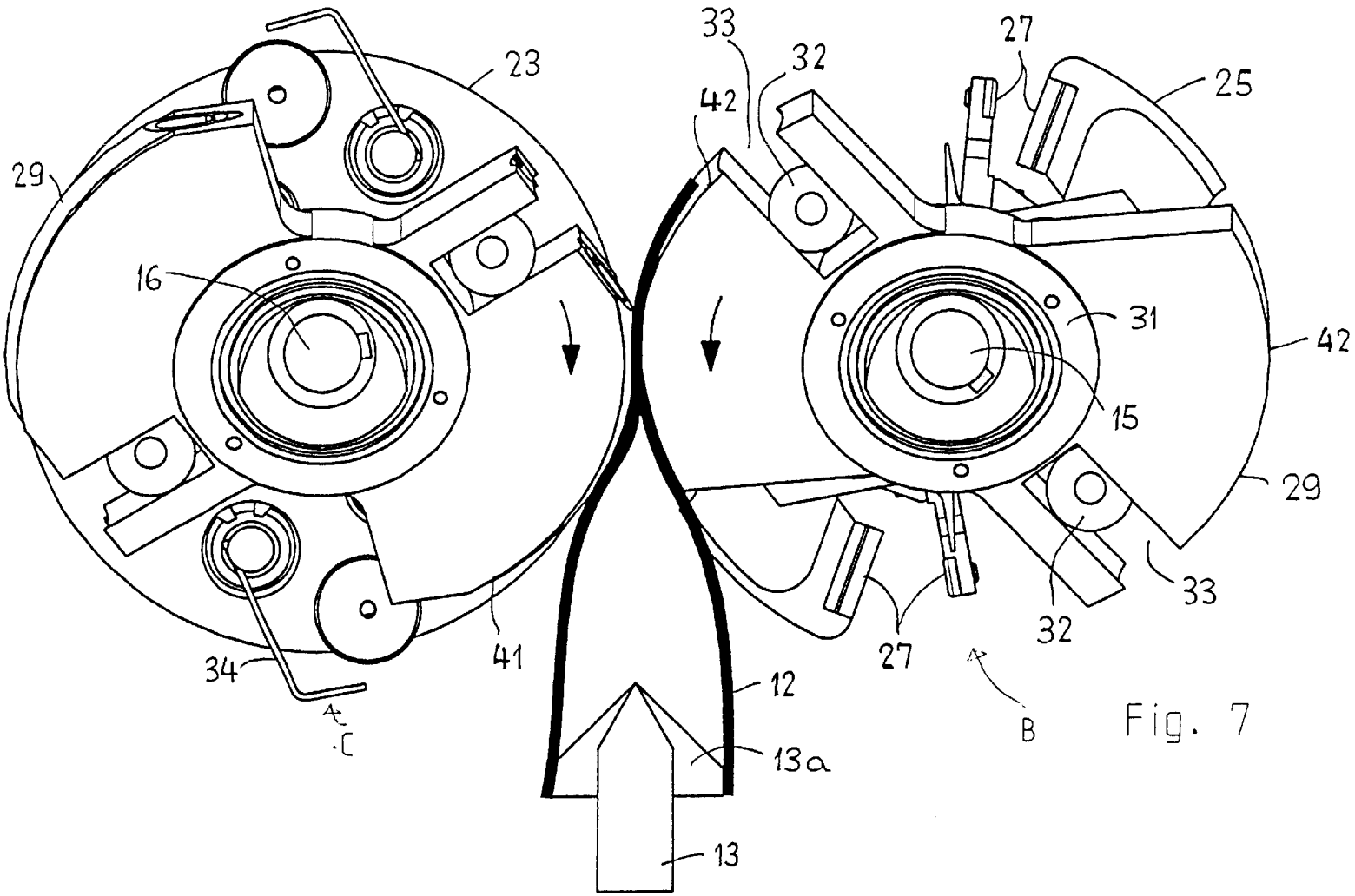
FIG. 7 is a section along the line VII—VII in FIGS. 3 and 4.
Figure 8:
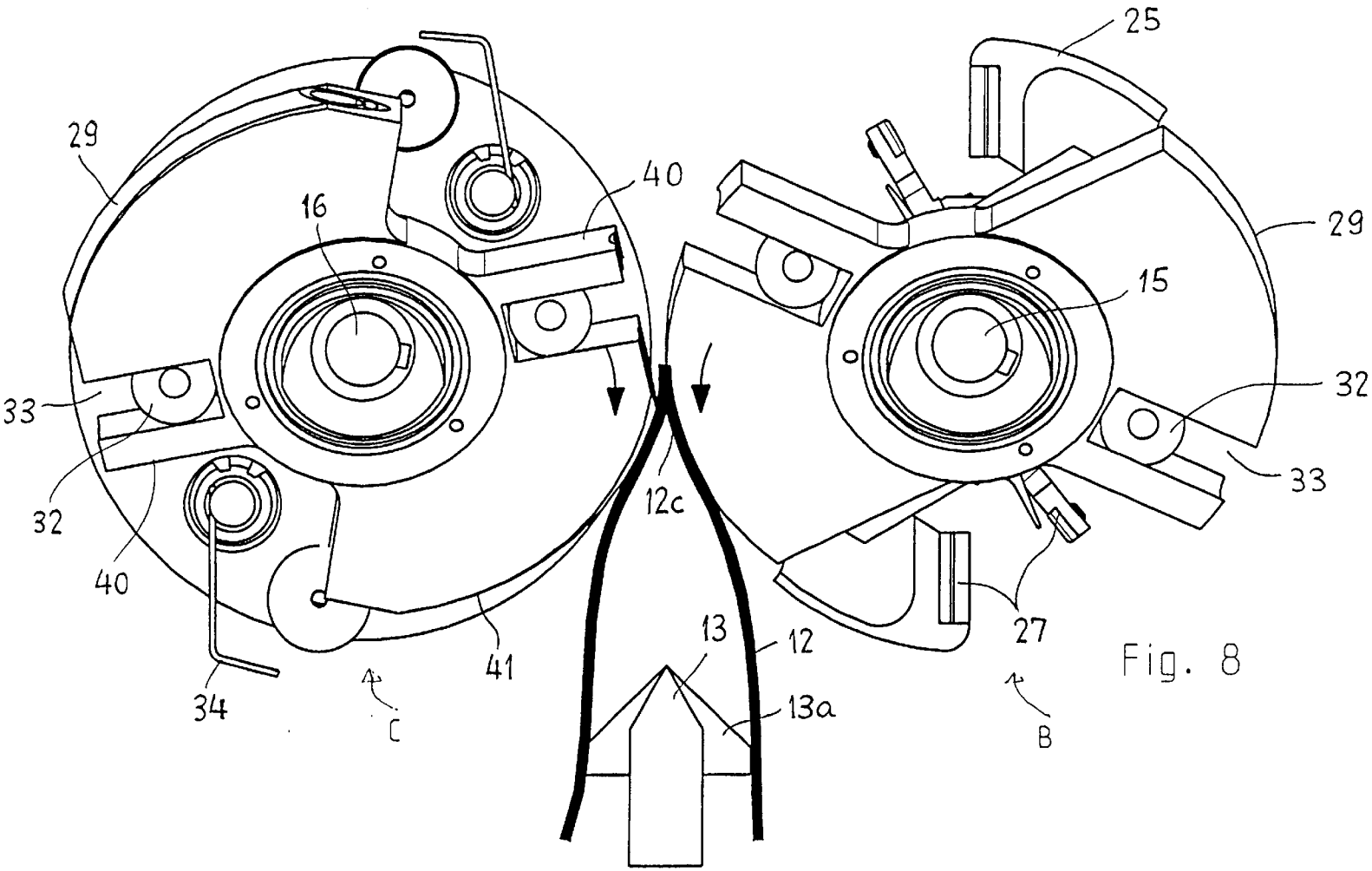
FIG. 8 is a section along the line VIII—VIII in FIGS. 3 and 4, showing another rotational position of shafts B and C.

Subsequently, signature 12 is transported further by accelerating rollers 29, as shown in FIG. 7. Signature 12 is transported according to the inclination of accelerating rollers 29. Based on this inclination, and thus corresponding to the angle $\alpha$, signature 12 is transported downward at an angle, relative to the conveying direction of conveyor chain 13. Signature 12 thus is provided with a speed component $V_2$ (see FIG. 11*a*) in the conveying direction of conveyor chain 13. Of necessity, signature 12 is transported at an angle by accelerating rollers 29 until the fold 12*c* has moved past the contact points of accelerating rollers 29. According to FIGS. 7 and 8, the opened underside of the signature 12 thus is moved to the level of carriers 13*a*. Following the position shown in FIG. 8, the signature 12 is thrown with a speed component in the direction of the chain movement onto the moving conveyor chain and is carried along by carriers 13*a*. The impact of carriers 13*a* on signature 12 is reduced by the aforementioned horizontal speed component. The aforementioned vertical drop component is reduced only slightly by the inclined position of the accelerating rollers 29. For that reason, even electrostatically charged signatures 12 can be dropped and processed further.

The horizontal speed component $V_2$ equals 45% of the speed of the conveyor chain 13 with a chain pitch of 14 inches (355.6 mm) if the diameter for opening disks 23 to 26 is 205 mm, for example, and if accelerating rollers 29 are inclined at an angle $\alpha$ of 30°. This speed component can be increased or reduced by changing the angle $\alpha$. An acceleration of up to 100% is possible in principle. However, as a rule, it only makes sense to have a pre-acceleration, so that signatures 12 are positioned on conveyor chain 13 by carriers 13*a* and are further accelerated horizontally.

Figure 11A:
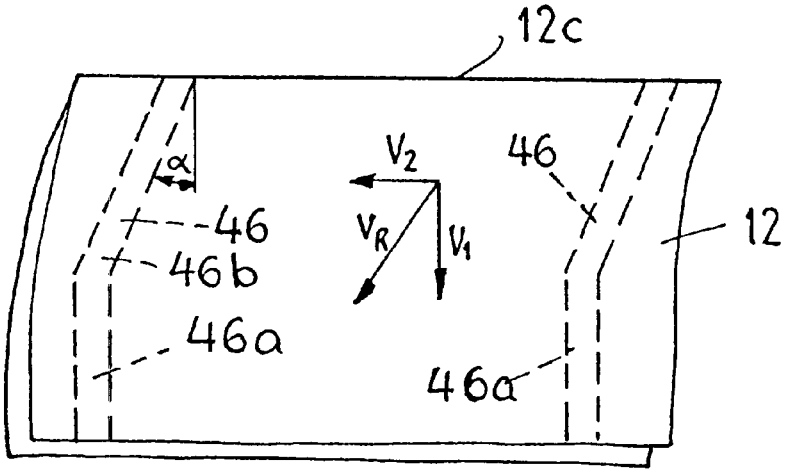
FIGS. 11*a* and 11*b* are diagrams showing different views of a signature, illustrating the clamping regions according to the respective embodiments of the invention.

FIG. 11*a* contains a diagram showing with dashed lines the clamping-in region 46 for signatures 12. In a region 46*a*, which extends perpendicular to fold 12*c*, the clamping occurs with the aid of opening disks 23 to 26. In an inclined region 46*b*, the clamping occurs with the aid of accelerating rollers 29. The continuous and sustained guidance of signatures 12 is visible here as well. The center of gravity for the signatures 12 is between the two strip-type segments of region 46. The clamping region 46 thus ensures that signatures 12 maintain a predetermined orientation until they are released and dropped onto the conveyor chain 13. The horizontal speed vector $V_2$ and the vertical speed vector $V_1$ result in the speed vector $V_R$ that extends downward and forward at an angle.

Figure 9:
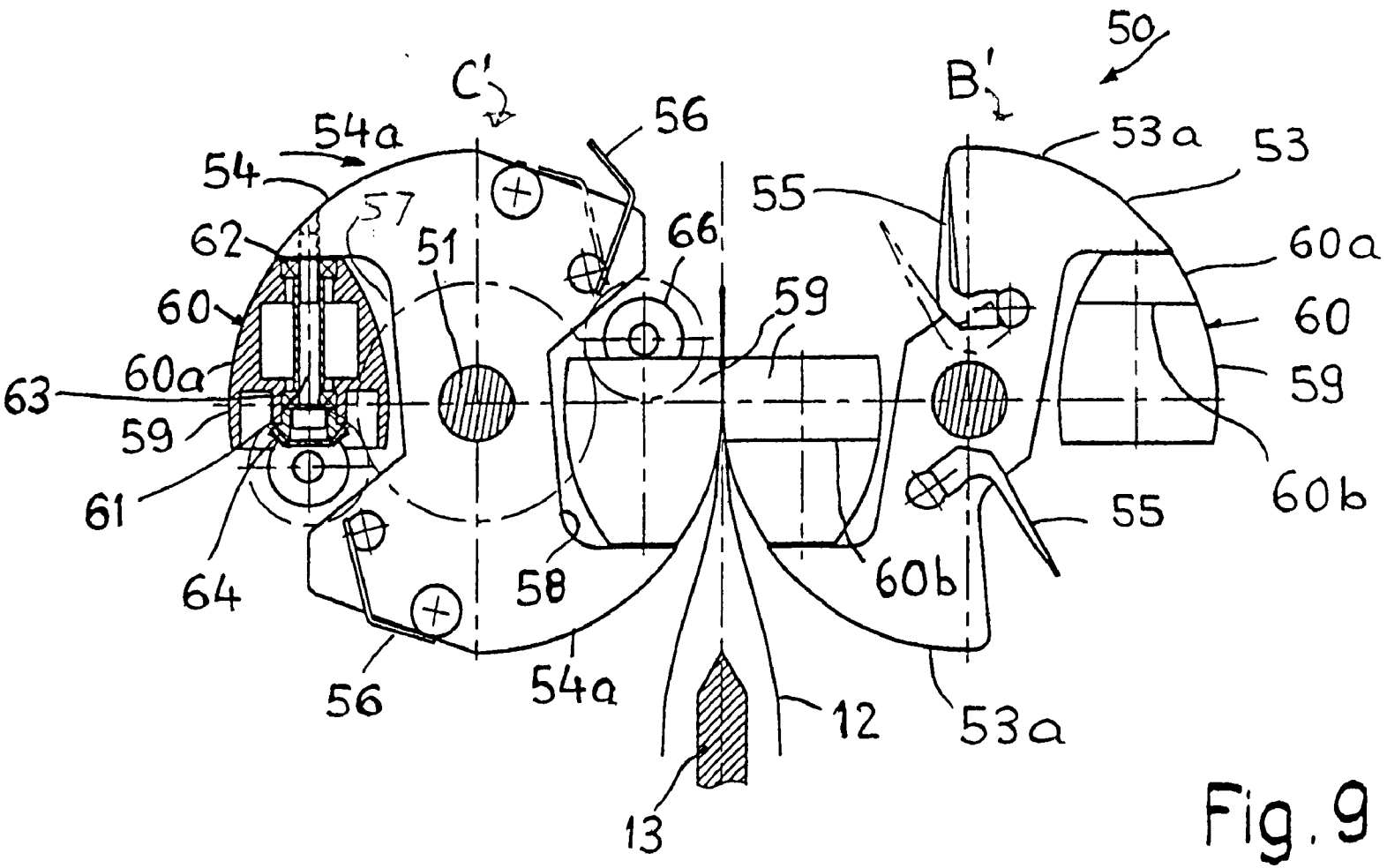
FIG. 9 is a section along the line IX—IX in FIG. 10.

FIGS. 9 and 10 show another embodiment of a device according to the invention, wherein signatures 12 are opened with the aid of opening rollers B' and C', in a similar manner as explained in the above, and are dropped onto a moving conveyor chain 13. The device for taking down the signatures 12 from a stack is omitted here as well. The rollers B' and C' are also provided with grippers 56 or 55 of a known design in order to seize and open signatures 12.

According to FIG. 10, opening rollers B' and C' have parallel shafts 51 and 52, respectively, which are positioned on opposite-arranged end plates 68 on bearings 69. Shafts 51 and 52 are also arranged parallel to conveyor chain 13, which is only indicated herein.

Two opening disks 53 are arranged on the shaft 51 and two opening disks 54 are arranged on shaft 52, at a distance to each other and parallel, and are connected such that they rotate along with the shafts 51 and 52. In FIG. 10, shafts 51 and 52 are driven such that signatures 12 are transported perpendicular into the drawing page and are opened.

In order to accelerate signatures 12 in the conveying direction of conveyor chain 13 opening disks 53 and 54 have respectively two rollers 59, which are arranged diametrically to each other and positioned so as to rotate. According to FIG. 9, rollers 59 have a beehive-shaped form and are respectively positioned on an axis 61, the rotational axis of which forms a chord to the circumferential circle of the respective opening disks 53 and 54. The positioning on shafts 56 respectively occurs with the aid of bearings 62 and 63 that are arranged at a distance to each other.

The rollers 59 are respectively arranged in a recess 57, such that the outer meridian line 60*a* of the roller surface 60 forms a circular segment of the circumferential circle for the opening disk. The transition from surface area 53*a* or 54*a* to roller surface 60 occurs preferably without interruption.

Rollers 59 are operated by means of a planet gear 70, as well as two parallel drive shafts 66. The planet gear 70 is supported with a bearing 71 on shaft 51 and is provided with a sun wheel 72, as well as a planet wheel 74 for each shaft 66. Sun wheel 72 is fixedly connected via a rod 73 to end plate 68, shown on the right in FIG. 10. The drive shafts 66 are positioned on two bearing plates 75, arranged at a distance to each other, which are rigidly connected to the shaft 51. Two conical gear wheels 67 that are arranged on each drive shaft 66 respectively mesh with a conical gear wheel 64, which is rigidly connected to a roller 60. If shaft 51 rotates, drive shafts 66 of necessity also rotate around the axis of shaft 51 while simultaneously rotating around their own axes. The rollers 59 rotate around their axes 61 in a corresponding manner. In FIG. 10, the rotational directions for rollers 59 are indicated with arrows 77. The rollers 59 of shaft 52 are driven in the opposite direction as those for shaft 51. The corresponding drive arrangement is not shown in FIG. 10 for drawing reasons.

The rollers 59 essentially serve the function of the accelerating rollers 29 for the above-explained device 14. However, the horizontal speed transmitted by the rollers 59 to the signatures 12 increases. This follows from the shape of rollers 59, which is beehive-shaped and rotationsymmetrical, relative to the axis 61. As shown in FIG. 9, the circumference of rollers 59 changes in accordance with the circumferential lines 60*b* as the distance to the bearing 62 increases. Owing to the fact that the rollers 59 rotate at a constant speed, the circumferential speed correspondingly increases continuously with increasing distance to the bearing 62.

Figure 11B:
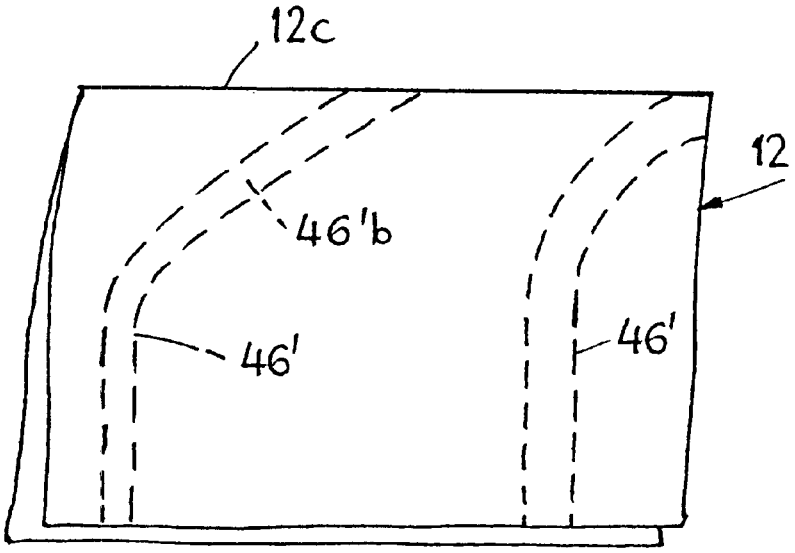

Signatures 12 are seized and opened as explained in the above and are subsequently conveyed between opposite arranged rollers 59, at an angle to the conveying direction of conveyor chain 13. Finally, they are dropped onto conveyor chain 13. The subsequent transition from a clamping with the aid of clamping surface 53*a* and 54*a* to a clamping with the aid of adjacent roller surfaces 60*a* also occurs continuously in this case. Since the signatures 12 are first seized in the region of bearings 62, the circumferential speed is correspondingly low at the beginning and then increases steadily up to the position shown in FIG. 9. Since the rollers 60 for device 50 are arranged directly at the opening disks 53 and 54, the clamping regions 46' according to FIG. 11*b* are positioned closer together for the acceleration of signatures 12, than for the above-explained device. The device 50 is therefore particularly suitable for depositing comparably small formats. The FIG. 11*b* furthermore shows that after the signatures are seized by the rollers 59, the clamping region 46' progresses in a curved shape, corresponding to the increasing horizontal speed.

The invention has been described in detail with respect to referred embodiments, and it will now be apparent from the foregoing to those skilled in the art, the changes and modifications may be made without departing from the invention in its broader aspects, and the invention, therefore, as defined in the appended claims, is intended to cover all such changes and modifications as to fall within the true spirit of the invention.

What is claimed is:

1. A device for opening and depositing folded signatures onto a moving conveyor for conveying the folded signatures in a conveying direction, comprising:

two opening rollers each having a rotational axis that extends essentially parallel to the conveying direction of the conveyor and having means for opening the respective signatures and depositing the signatures with an opened side first in a downward direction onto the conveyor, wherein the opening rollers further include pre-accelerating means for pre-accelerating the respective signatures in the conveying direction.

2. A device according to claim 1, wherein the pre-accelerating means are arranged for seizing the respective signatures on the outside surfaces at respective clamping-in regions that roll off in opposite directions.

3. A device according to claim 1, wherein the opening rollers respectively comprise two opening disks and the opening means releases the signatures respectively after opening them so that the signatures are seized by the pre-accelerating means which are operatively arranged with the opening rollers for accelerating the signatures in the conveying direction before the signatures are dropped onto the conveyor.

4. A device according to claim 3, wherein the opening disks include gaps along their respective circumferences to present specific partial regions on the circumference of the opening disks that respectively seize the signatures.

5. A device according to claim 3, wherein the two opening rollers each include a shaft defining an axis of rotation and the pre-accelerating means include respective accelerating rollers arranged at an angle on a respective one of the shafts for the two opening rollers.

6. A device according to claim 5, wherein the accelerating rollers include gaps along their circumference.

7. A device according to claim 5, wherein the accelerating rollers are arranged for seizing and accelerating the individual signatures immediately after the signatures are released by the opening disks.

8. A device according to claim 5, and further including a non-rotating frame on which the accelerating rollers are respectively located.

9. A device according to claim 5, and further including guide rods extending parallel to the axis of rotation for the opening rollers and connecting the accelerating rollers to a drive.

10. A device according to claim 9, wherein the guide rods each include a ball and the accelerating rollers each contain a radially extending guide slot inside of which the ball of the guide rod is arranged for guidably moving the guide rod.

11. A device according to claim 5, wherein the pre-accelerating means on each shaft comprises two accelerating rollers and the two opening disks on that shaft are arranged between the two accelerating rollers.

12. A device according to claim 11, wherein the opening disks and the accelerating rollers on the respective shafts are arranged to operate together in pairs.

13. A device according to claim 5, wherein the accelerating rollers each include a circumferential surface and respectively one elastic support on the circumferential surface for seizing the signatures to be accelerated.

14. A device according to claim 5, wherein the signatures each have a fold line and outside surfaces, and the accelerating rollers seize a respective one of the signatures to be accelerated respectively on the outside surfaces and roll off on the signatures at an angle to the fold line.

15. A device according to claim 14, wherein the accelerating rollers in each case roll off only in an upper region of the outside surfaces near the fold line.

16. A device according to claim 1, wherein the opening rollers comprise opening disks and the pre-accelerating means are arranged on the opening disks.

17. A device according to claim 16, wherein each opening roller comprises two opening disks and the pre-accelerating means includes two driven rollers each arranged on a respective one of the opening disks, the two driven rollers operating jointly to seize and accelerate a signature.

18. A device according to claim 17, wherein the two driven rollers each have a beehive-shaped form.

19. A device according to claim 17, wherein each one of the driven rollers has an axis of rotation that forms a chord to the circumference of the opening disk on which the driven roller is located.

20. A device according to claim 17, wherein each opening disk includes a recess inside of which a respective one of the driven rollers is arranged, and each driven roller has a circumference that forms a circular arc with a meridian line which is flush with a forward-running circumferential region of the opening disk.

21. A device according to claim 17, wherein each driven roller has a circumference that increases continuously, as seen in a movement direction of the signatures, so that the signatures, respectively, are accelerated continuously in the conveying direction of conveyor.

22. A device according to claim 17, wherein each opening disk includes two diametrically opposite-arranged driven rollers.

23. A device according to claim 17, wherein each opening disk includes a rotatable shaft, and the device further includes a planet gear supported on the shaft of a corresponding one of the opening disks and being operatively arranged for driving a respective one of the driven rollers.

* * * * *